US008465022B2

(12) United States Patent
Weiss et al.

(10) Patent No.: US 8,465,022 B2
(45) Date of Patent: Jun. 18, 2013

(54) TOSS CARD GAME FOR SIMULATING SPORTS

(76) Inventors: Lawrence B. Weiss, Dandridge, TN (US); Sande R. Weiss, Dandridge, TN (US)

( * ) Notice: Subject to any disclaimer, the term of this patent is extended or adjusted under 35 U.S.C. 154(b) by 0 days.

(21) Appl. No.: 13/050,253

(22) Filed: Mar. 17, 2011

(65) Prior Publication Data

US 2012/0235356 A1 Sep. 20, 2012

(51) Int. Cl.
*A63F 3/00* (2006.01)

(52) U.S. Cl.
USPC ..... 273/298; 273/277

(58) Field of Classification Search
USPC ..... 273/298, 244, 259, 277
See application file for complete search history.

(56) References Cited

U.S. PATENT DOCUMENTS 2,886,319 A * 5/1959 Henderson ..... 273/244.2
5,472,191 A * 12/1995 Hendricks ..... 273/244
5,624,120 A * 4/1997 Frank-Opigo ..... 273/279
5,967,518 A 10/1999 Rowe
6,257,576 B1 * 7/2001 Pontacoloni ..... 273/244
6,761,632 B2 * 7/2004 Bansemer et al. ..... 463/16
7,040,623 B2 * 5/2006 Poffenberger ..... 273/236
7,845,644 B2 12/2010 Constantine et al.
7,887,059 B2 2/2011 Kiernan
2005/0062232 A1 * 3/2005 Pavlik et al. ..... 273/408
2008/0042360 A1 2/2008 Veikley

* cited by examiner

*Primary Examiner* — Vishu K. Mendiratta
(74) *Attorney, Agent, or Firm* — Luedeka Neely Group, P.C.

(57) ABSTRACT

A game system for use with an object tossing game board such as a cornhole game board is disclosed for simulating a sport. The game system includes a plurality of playing cards so that one of at least a first player and a second player draws one of the plurality of cards during a player turn, each of the plurality of playing cards having tossing instruction information including identification of an award representing an activity involved in the sport and identification of an attempt number representing a number of tosses in which one of the first player and the second player has to successfully toss the object to the object tossing game board during the player turn to obtain the award.

1 Claim, 9 Drawing Sheets

| AWARD | ATTEMPT NUMBER | NUMBER OF CARDS |
|---|---|---|
| 10 Yard Run | 4 | 4 |
| 10 Yard Pass | 4 | 4 |
| 20 Yard Run | 4 | 4 |
| 20 Yard Pass | 4 | 4 |
| 30 Yard Run | 4 | 2 |
| 30 Yard Pass | 4 | 2 |
| 40 Yard Run | 3 | 2 |
| 40 Yard Pass | 3 | 2 |
| 50 Yard Run | 2 | 2 |
| 50 Yard Pass | 2 | 2 |
| Recovered Fumble – Touchdown | 1 | 2 |
| Intercepted Pass – Touchdown | 1 | 2 |
| Facemask – Move Forward 15 Yards | 4 | 2 |
| Pass Interference – Move Forward 20 Yards | 4 | 2 |
| Offsides – Move Forward 10 Yards | 4 | 1 |
| Sacked – Move Opponent Back 10 Yards | 4 | 2 |
| Offsides – Move Opponent Back 10 Yards | 4 | 1 |
| Delay of Game – Move Opponent Back 5 Yards | 4 | 2 |
| Too Many Players on Field – Move Forward 5 Yards | 4 | 1 |
| Too Many Players on Field – Move Opponent Back 5 Yards | 4 | 1 |
| Personal Foul – Move Forward 15 Yards | 4 | 1 |
| Personal Foul – Move Opponent Back 15 Yards | 4 | 1 |
| Excessive Celebration – Move Opponent Back 15 Yards | 4 | 2 |
| Roughing Quarterback – Move Forward 15 Yards | 4 | 2 |
| Holding – Move Forward 10 Yards | 4 | 1 |
| Holding – Move Opponent Back 10 Yards | 4 | 1 |

FIG. 3

| AWARD | ATTEMPT NUMBER | NUMBER OF CARDS |
|---|---|---|
| Base Hit Single | 4 | 5 |
| Double | 3 | 5 |
| Triple | 2 | 4 |
| Home Run | 1 | 2 |
| Third Out – Inning Over Opponent Loses All Base Runners OR Single Run | 2 | 2 |
| Strike Out – Opponent Loses Turn Advance to First Base and Draw Again | 2 | 2 |
| Stolen Base – Advance All Runners One Base OR Single Run | 4 | 5 |
| Sacrifice Fly – Advance All Runners One Base OR Single Run | 4 | 5 |
| Tag Out – Remove Any One of Your Opponents Runners from Board OR Single Run | 4 | 2 |
| Successful Bunt – Advance All Runners One Base | 4 | 3 |
| Umpire Threw You Out for Kicking Dirt – Lose Turn | WILD CARD | 1 |
| Bases Loaded – Load All Bases OR Double | 2 | 2 |
| Double Play – Remove Two of Opponent's Runners off Scoreboard OR Single | 3 | 3 |
| Grand Slam – Bases Loaded Add Four Runs to Scoreboard | 1 | 1 |
| Intentional Walk – Advance to First Base | 4 | 5 |
| Picked Off – Remove One of Opponent's Runners off Scoreboard OR Single | 4 | 5 |

FIG. 5

| AWARD | ATTEMPT NUMBER | NUMBER OF CARDS |
|---|---|---|
| 2 lb Bass Per Toss | 4 | 2 |
| 1 lb Bass Per Toss | 4 | 4 |
| 5 lb Bass | 4 | 3 |
| 3 lb Bass | 4 | 2 |
| 2 lb Bass | 4 | 2 |
| 8 lb Bass | 2 | 3 |
| 10 lb Bass | 2 | 3 |
| 4 lb Bass Per Toss | 4 | 2 |
| 3 lb Bass Per Toss | 4 | 4 |
| 5 lb Bass Per Toss | 3 | 3 |
| 6 lb Bass Per Toss | 3 | 2 |
| 7 lb Bass Per Toss | 3 | 2 |
| 9 lb Bass | 3 | 2 |
| Honey Hole – 6lb Bass Per Toss | 4 | 2 |
| Honey Hole – 5lb Bass Per Toss | 4 | 2 |
| Honey Hole –7 lb Bass Per Toss | 4 | 2 |
| Game Warden Ticket – Fishing Without a License Opponent Loses 1/2 of Total Poundage | 1 | 1 |
| Game Warden Ticket – Over Limit Subtract 10lbs From Opponent Total | 3 | 2 |
| Game Warden Ticket – No Life Jacket Subtract 10lbs From Opponent Total | 3 | 2 |
| Game Warden Ticket – NO WAKE ZONE Subtract 5lbs From Opponent Total | 4 | 1 |
| Game Warden Ticket – No Floatation Device Subtract 5lbs from Opponent Total | 4 | 2 |
| Game Warden Ticket – No Fire Extinguisher Subtract 5lbs From Opponent Total | 4 | 2 |
| WORLD RECORD Largemouth Bass – 23 lbs | 1 | 1 |
| WORLD RECORD Smallmouth Bass – 12 lbs | 1 | 1 |

FIG. 6

| AWARD | ATTEMPT NUMBER | NUMBER OF CARDS |
|---|---|---|
| Technical Foul – Opponent Arguing with Ref – Toss From 15' Line – Draw Again | 2 | 1 |
| 2nd Technical Foul – Opponents Coach Ejected – Toss From 15' Line – Draw Again | 2 | 1 |
| Technical Foul – Opponent Fighting – Toss From 15' Line – Draw Again | 2 | 1 |
| Technical Foul – Opponent Called Time Out With None Remaining – Toss from 15' Line – Draw Again | 2 | 1 |
| DUNK – Shoot From 10' Line Using Opposite Hand – 2 Points | 1 | 2 |
| 10th Team Foul – Bonus – 2 Free Throws From 15' Line | 2 | 2 |
| Fouled – Bonus – 2 Free Throws 15' Line | 2 | 2 |
| 9th Team Foul – Shoot 1 & 1 From 15' Line | 1 & 1 | 2 |
| 8th Team Foul – Shoot 1 & 1 From 15' Line | 1 & 1 | 2 |
| 7th Team Foul – Shoot 1 & 1 From 15' Line | 1 & 1 | 2 |
| Goal Tending – 2 Points | 4 | 4 |
| 3 Point Shot Made & Fouled – 4 Point Play | 2 | 4 |
| 3 Point Shot Attempted – Fouled – Toss From 15' Line | 3 | 4 |
| 3 Point Shot Made | 3 | 7 |
| 2 Point Shot Made & Fouled – 3 Point Play | 3 | 4 |
| 2 Point Shot Attempted & Fouled – Toss From 15' Line | 2 | 4 |
| 2 Point Shot Made | 4 | 9 |

FIG. 7

| STATE & ELECTORAL VOTES | ATTEMPT NUMBER |
|---|---|
| Alabama – 9 | 4 |
| Alaska – 3 | 4 |
| Arizona – 11 | 3 |
| Arkansas – 6 | 4 |
| California – 55 | 1 |
| Colorado – 9 | 4 |
| Connecticut – 7 | 4 |
| Delaware – 3 | 4 |
| District of Columbia – 3 | 4 |
| Florida – 29 | 2 |
| Georgia – 16 | 3 |
| Hawaii – 4 | 4 |
| Idaho – 4 | 4 |
| Illinois – 20 | 3 |
| Indiana – 11 | 3 |
| Iowa – 6 | 4 |
| Kansas – 6 | 4 |
| Kentucky – 8 | 4 |
| Louisiana – 8 | 4 |
| Maine – 4 | 4 |
| Maryland – 10 | 4 |
| Massachusetts – 11 | 3 |
| Michigan – 16 | 3 |
| Minnesota – 10 | 4 |
| Mississippi – 6 | 4 |

| STATE & ELECTORAL VOTES | ATTEMPT NUMBER |
|---|---|
| Missouri – 10 | 4 |
| Montana – 3 | 4 |
| Nebraska – 5 | 4 |
| Nevada – 6 | 4 |
| New Hampshire – 4 | 4 |
| New Jersey – 14 | 3 |
| New Mexico – 5 | 4 |
| New York – 29 | 2 |
| North Carolina – 15 | 3 |
| North Dakota – 3 | 4 |
| Ohio – 18 | 3 |
| Oklahoma – 7 | 4 |
| Oregon – 7 | 4 |
| Pennsylvania – 20 | 3 |
| Rhode Island – 4 | 4 |
| South Carolina – 9 | 4 |
| South Dakota – 3 | 4 |
| Tennessee – 11 | 3 |
| Texas – 38 | 1 |
| Utah – 6 | 4 |
| Vermont – 3 | 4 |
| Virginia – 13 | 3 |
| Washington – 12 | 3 |
| West Virginia – 5 | 4 |
| Wisconsin – 10 | 4 |
| Wyoming – 3 | 4 |

FIG. 8

| AWARD | NUMBER OF CARDS |
|---|---|
| Hooked Ball In Woods, Add One Stroke | 1 |
| Sliced Ball In Woods, Add One Stroke | 1 |
| Sculled the Ball and Dribbled Only 2 FT, Add One Stroke | 1 |
| Shankopotamus! – Shanked the Ball Into Golf Cart, Add One Stroke | 1 |
| Worm Burner! – Didn't Make It Past the Woman's Tee, Add One Stroke Alice | 1 |
| Out of Bounds, Add One Stroke | 1 |
| Sand Trap, Add One Stroke | 1 |
| Lost Ball, Add One Stroke | 1 |
| Water Hazard, Add One Stroke | 1 |
| Broke Club! – Bad Sportsmanship, Add One Stroke | 1 |
| In the Woods, Add One Stroke | 1 |
| Sky Ball! Brought Rain, Add One Stroke | 1 |
| Mulligan | 24 |
| Drove Green In Regulation, Begin Putting | 4 |
| First Drive Hit Cart Path Rolled Onto Green, Begin Putting | 8 |
| Lucky Bounce, Take One Stroke Away | 4 |

FIG. 9

TOSS CARD GAME FOR SIMULATING SPORTS

FIELD

This invention relates to the field of card games. More particularly, this invention relates to a card game for simulating sports that involves the physical skill of tossing an object at an object tossing game board such as a cornhole board.

BACKGROUND

While the game of cornhole (also referred to as corn toss, bean bag toss, bean toss, soft horseshoes, indiana horseshoes, Tailgate Toss®, etc.) has been around since at least the 1950s, its popularity began to significantly increase in the late 1990s. Cornhole is played by throwing cornhole bags or bean bags (bags filled with PVC pellets, feed corn, etc.) at an angled platform having a target hole disposed in the platform. The platforms are usually made from plywood or plastic.

In general, the game of cornhole is played by two or more players divided into two teams. Cornhole matches are broken down into innings or frames of play. During each inning, one player from each team throws four bags. In order to score, the bags must either be tossed into the hole or land on the platform. A bag that falls through the hole is worth a value of three points. The bag can be tossed directly into the target hole, slide into the hole, or be knocked into the hole by another bag. A bag that lands on the platform and is still on the platform at the end of the inning is worth one point. Usually, cancellation scoring is used. In cancellation scoring, bags that fall in the hole and bags that land on the board that are pitched by opponents during a frame cancel each other out. In other words, if one player scores four points and the other player scores three points, the first player's team receives one point for the inning. Play continues until a team reaches the score of 21.

While the game of cornhole has significantly grown in popularity, the game is generally always played the same way. Accordingly, it is likely a fad that will be replaced in time by the newest and latest trend unless popular variations of the game can be developed that incorporate the tossing aspect of the game with new features and characteristics. For example, the game of cornhole is associated with sports as it is often played during tailgates at sporting events. However, cornhole does not represent in any way the sporting events such as football, baseball, and basketball games that people are attending. If people were tailgating for a football game, they would prefer to play a game that at least somewhat resembles actual football. Additionally, cornhole is often played by competitive people that are often interested in sports such as football, basketball, golf, baseball, etc. Accordingly, it would be desirable to develop a game that incorporates the tossing aspect of cornhole with additional features that simulate other sports.

One characteristic of cornhole that undoubtedly influences the game's rising popularity is that cornhole is generally a game of skill that one can develop a greater expertise in through playing more frequently and/or having greater natural abilities. However, while the game is simple enough that anyone can play, those that are not as skilled at the game may get tired of it as they continually get beat by better cornhole players and/or the better players may get tired of the game because they do not have much competition. On the other hand, games that combine an element of luck with a certain amount of skill, such as poker, are often quite popular because they tend to level the playing field between highly skilled players and those that are not quite as skilled. Thus, although one player may be more skilled than their opponent in a particular game so that they win against that opponent more than they will lose over the long run, a game that also includes an element of luck gives the player of lesser skill the ability to still beat a higher skilled player. Accordingly, it would be desirable to develop a game that incorporates the tossing aspect of cornhole with the features of a card game that involves a certain amount of luck.

SUMMARY

Embodiments of the invention described herein pertain to a game system for use with an object tossing game board for simulating a sport. The game system includes a plurality of playing cards for allowing one of at least a first player and a second player to draw one of the plurality of cards during a player turn. Each of the plurality of playing cards includes tossing instruction information including identification of an award representing an activity involved in the sport and identification of an attempt number representing a number of tosses in which one of the first player and the second player has to successfully toss the object to the object tossing game board during the player turn to obtain the award. The attempt number of the tossing instruction information may be determined at least in part on a significance of the award identified by the instruction information to the sport.

According to some embodiments of the invention, the object tossing game board is a cornhole game board having an angled platform including a target hole disposed on the platform, and the player successfully tosses the object to the tossing game board to obtain the award when the object travels through the target hole. The game system may include the object tossing game board or be provided separately for use with the object tossing game board.

According to some embodiments, the simulated sport of the game system is football and the game system further includes a scoreboard representing a football field and at least two game pieces each representing one of the first player and the second player. The game pieces are moved along the scoreboard based at least in part on whether one of the first player and the second player obtains the award during the player turn. The scoreboard may include at least one goal line, and the first player and the second player scores a touchdown when their respective game piece is moved along the scoreboard to the goal line. The plurality of playing cards may include a first set of cards and a second set of cards, the award of the first set of cards including a tosser award for moving the game piece of one of the first player during a first player turn and the second player during a second player turn and the award of the second set of cards including an opponent award for moving the game piece of one of the first player during the second player turn and the second player during the first player turn.

According to some embodiments, the simulated sport is fishing and the award of the tossing instruction information includes at least one of a weight of a fish caught and a game warden ticket to be issued to an opponent resulting in the opponent having to subtract weight from a total weight of fish caught.

In other embodiments, the simulated sport is a presidential election and each of the plurality of playing cards represents a state, the award of the tossing information including a total electoral votes of the state represented by one of the plurality of playing cards and the attempt number is based at least in part on the total electoral votes of the award identified on each of the plurality of playing cards.

According to some embodiments, the simulated sport is baseball and the game system further includes a scoreboard depicting at least one baseball diamond, a first set of game pieces representing base runners of the first player, and a second set of game pieces representing base runners of the second player, the game pieces being moved along the scoreboard based at least in part on whether one of the first player and the second player obtains the award during the player turn.

According to some embodiments, the simulated sport is basketball and the tossing instruction information further includes identification of one of a plurality of distances from the tossing game board in which one of the first player and the second player must attempt to toss the object to the object tossing game board during the player turn.

In another embodiment of the invention, a card game system is disclosed for simulating a sport using a cornhole game board having an angled platform including a target hole disposed on the platform. The game system includes a plurality of playing cards so that one of at least a first player and a second player draws one of the plurality of cards during a player turn. Each of the plurality of playing cards includes tossing instruction information including identification of an award representing an activity involved in the sport, and one of the first player and the second player obtains the award when tossing an object through the target hole during the player turn.

According to some embodiments, the tossing instruction information further includes identification of an attempt number representing a number of tosses in which one of the first player and the second player has to successfully toss the object through the target hole during the player turn to obtain the award, the attempt number of the tossing instruction information being determined at least in part on a significance of the award to the sport.

In yet another embodiment of the invention, a method for playing a tossing and card game that simulates a sport is disclosed. The method includes the following steps: (a) providing a cornhole game board having an angled platform including a target hole disposed on the platform; (b) providing a plurality of playing cards each having tossing instruction information including identification of an award representing an activity involved in the sport and an attempt number representing a number of tosses in which one of a first player and a second player has to toss an object through the target hole of the cornhole game board in order to obtain the award; (c) drawing one of the plurality of playing cards during a first player turn taken by the first player; (d) tossing the object during the first player turn according to the attempt number identified in the drawn playing card and awarding the first player the award identified in the drawn playing card if the first player successfully tosses the object through the target hole; (e) drawing one of the plurality of playing cards during a second player turn taken by the second player; (f) tossing the object during the second player turn according to the attempt number identified in the drawn playing card and awarding the second player the award identified in the drawn playing card if the second player successfully tosses the object through the target hole; and (g) repeating steps (c)-(f) until one of each of the plurality of playing cards has been drawn, one of the first player and the second player reaches a stated point total, and a stated time period has elapsed.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein:

FIG. 3 depicts the tossing instruction information of a plurality of playing cards of a football game system according to one embodiment of the present invention;

FIG. 5 depicts the tossing instruction information of a plurality of playing cards of a baseball game system according to one embodiment of the present invention;

FIG. 6 depicts the tossing instruction information of a plurality of playing cards of a fishing game system according to one embodiment of the present invention;

FIG. 7 depicts the tossing instruction information of a plurality of playing cards of a basketball game system according to one embodiment of the present invention;

FIG. 8 depicts the tossing instruction information of a plurality of playing cards of a presidential election game system according to one embodiment of the present invention; and FIG. 9 depicts the tossing instruction information of a plurality of playing cards of a golf game system according to one embodiment of the present invention.

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Object Tossing Game Board:

An apparatus having at least one target configured to receive an object being thrown at the target for the purpose of playing a game. While the preferred embodiment of the object tossing game board is a cornhole board, other object tossing game boards may include a ladder toss stand (a/k/a the Ladder Golf® ladder), horseshoes, etc.

Object:

An apparatus that can be tossed or thrown at the target of the object tossing game board. Objects may include, for example, cornhole bags, bean bags, balls, bolas (used for ladder toss).

Successful Toss:

A toss of the object to the object tossing game board in which the object is received at the target.

Sport:

A skillful activity governed by a set of rules in which multiple teams or players compete against each other. Sports may include, for example, standard sports such as football, basketball, golf, baseball, and fishing, and non-standard sports such as a presidential election.

Award:

Any action, activity, movement, score, etc. involved in a particular sport that influences a winner of the sport. An award may include, for example, completing a pass in football for a particular gain in yardage, making a free throw in basketball and being rewarded one point for the made free throw, catching a fish of a particular weight, hitting a home run in baseball, and obtaining a state's electoral votes during a presidential election. An award is obtained in the present invention when the object is successfully tossed to the target of the object tossing game board.

Player:

A participant of the game of the present invention. A player may include a single player representing one team or a plurality of players representing one team. In other words, a "first player" may refer to a first single player or may refer to a first team and a "second player" may refer to a second single player or may refer to a second team.

Plurality of Cards:

A number of cards or deck of cards wherein one of the plurality of cards is drawn during a player's turn.

Player Turn:

Time in which a player draws a card from one of the plurality of cards and follows the tossing instruction information shown on the drawn card.

Attempt Number:

A number of tosses or throws in which a player may attempt to successfully toss the object to the target of the object tossing game board during a player turn.

Figure 1:
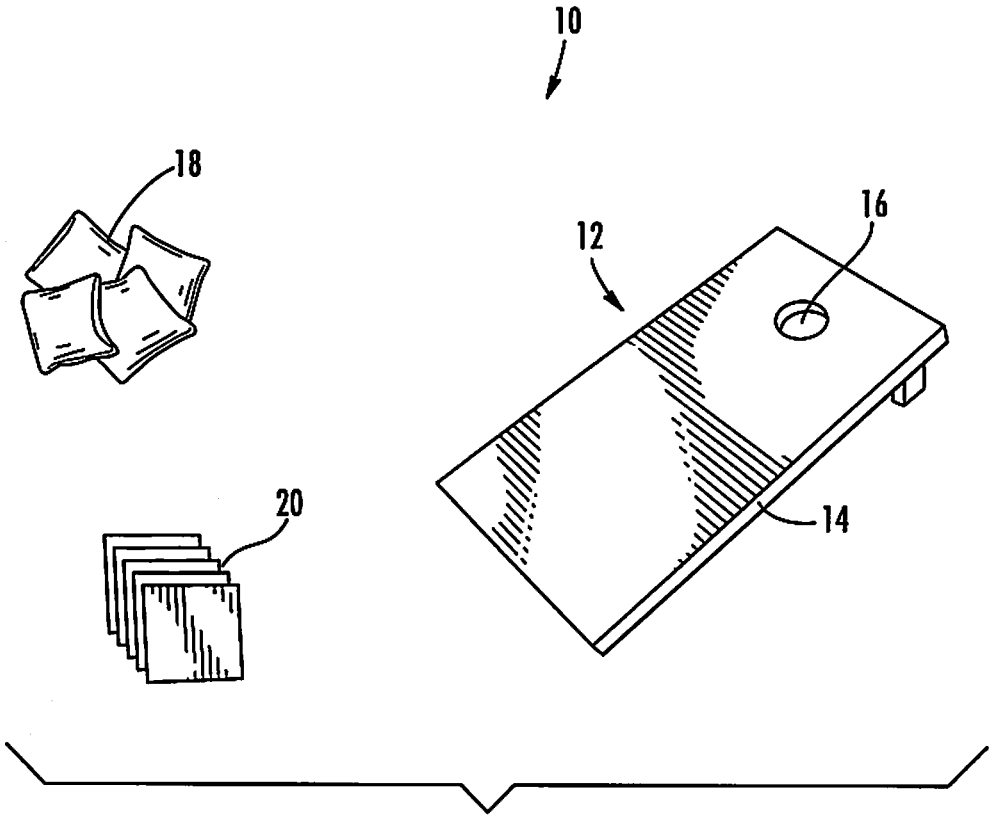
FIG. 1 depicts a game system according to one embodiment of the game system of the present invention.

Referring to FIG. 1, a game system 10 according to the present invention includes an object tossing game board 12, a plurality of objects 18 for tossing to the object tossing game board 13, and a plurality of cards 20. The object tossing game board 12 of FIG. 1 is shown in the form of a typical cornhole game board 12. The cornhole game board 12 includes an angled platform 14 having at least one target hole 16 disposed on the platform 14 for attempting to toss one of a plurality of objects 18 through the target hole 16. It should be understood that while a cornhole game board 12 is depicted and described below, other object tossing game boards 12 are within the scope of the present invention. Furthermore, the game system 10 may be provided with or without the object tossing game board 12 as many people already have their own object tossing game boards 12. In other words, the plurality of cards 20 of the present invention are intended to be operable with existing object tossing game boards 12 such as the cornhole game board.

The plurality of cards 20 are used in conjunction with the cornhole game board 12 as a card game that simulates a variety of sports. The game is to be played by at least a first player and a second player. During a player turn, one of the first player and the second player draw one of the plurality of cards 20 and toss an object at the cornhole game board 12 according to the tossing instruction information identified on the drawn card. The tossing instruction information may include identification of an award representing an activity involved in the sport. In order to obtain the award identified on the drawn card, the player must successfully toss the object to the cornhole game board 12. In preferred embodiments of the game, a successful toss includes tossing the object through the target hole 16. However, in other embodiments, a successful toss could also include tossing the object so that it rests on the platform 14. In this instance, the platform is a target as opposed to or in addition to the target hole 16. If other types of object tossing game boards are used, a successful toss will generally be defined as a toss that conforms to a successful toss for the particular game board. For example, a successful toss using a ladder toss stand would be successfully wrapping the bola around one of the rungs of the ladder.

In addition to an award, each of the plurality of cards 20 may also include an attempt number representing a number of tosses in which the player who draws the card has to successfully toss the object to the object tossing game board during the player turn. For example, if the attempt number is four (4) then the player receives four attempts to successfully toss the object through the target hole 16 of the cornhole game board 12. In preferred embodiments, the attempt number is based at least in part on the significance of the award identified by the drawn card to the sport that is being simulated. For example, if the simulated sport is football and the award identified by the drawn card is a touchdown, the attempt number may be smaller than that of a drawn card having the award identified as a ten yard completed pass because an automatic touchdown is more significant to the sport being simulated.

In another aspect of the invention, the number of plurality of cards 20 having a particular award identified may also vary based on the significance of the award. For example, there may be fewer cards among the plurality of cards 20 having an award of a homerun in a simulated baseball game due to the significance of the award to baseball. Thus, the game system 10 involves an element of luck due to the fact that each player has a chance to draw a significant award that may considerably influence the game more so than less significant cards. However, the game system 10 also involves an element of skill because, even after being lucky enough to draw the significant award during a player turn, the player must also successfully toss the object to the cornhole game board 12 in order to obtain the significant award.

The plurality of cards 20 may also include a first set of cards having a tosser award and a second set of cards having an opponent award identified by the tossing instruction information. When a tosser award is obtained by successfully tossing the object to the cornhole board 12, the award positively impacts the player whose turn it was and drew the tosser award card. On the other hand, when an opponent award is obtained, the award negatively impacts the opponent of the player whose turn it was and drew the opponent award card. For example, when playing a fishing simulated game, the first player draws a card from the plurality of cards 20. If the drawn card is a tosser award card, the award the first player will attempt to obtain may include catching a five pound fish per successful toss so that the total weight of fish caught by the first player is increased if the first player obtains the tosser award. However, if an opponent award card is drawn, the award the first player will attempt to obtain may include a "Game Warden Ticket" in which the first player's opponent will have to subtract ten pounds from their total amount of fish caught if the first player obtains the opponent award.

Embodiments of the invention are described below involving different sports that the game system 10 may simulate. It should be understood that rules and procedures provided for each variation of the game system 10 is exemplary and may be modified within the scope of the present invention. For example, the attempt numbers identified by the tossing instruction information and the number of significant cards included among the plurality of cards 20 may be altered to make the game more difficult and/or make it more or less likely for a player to obtain a significant award card.

Figure 2:
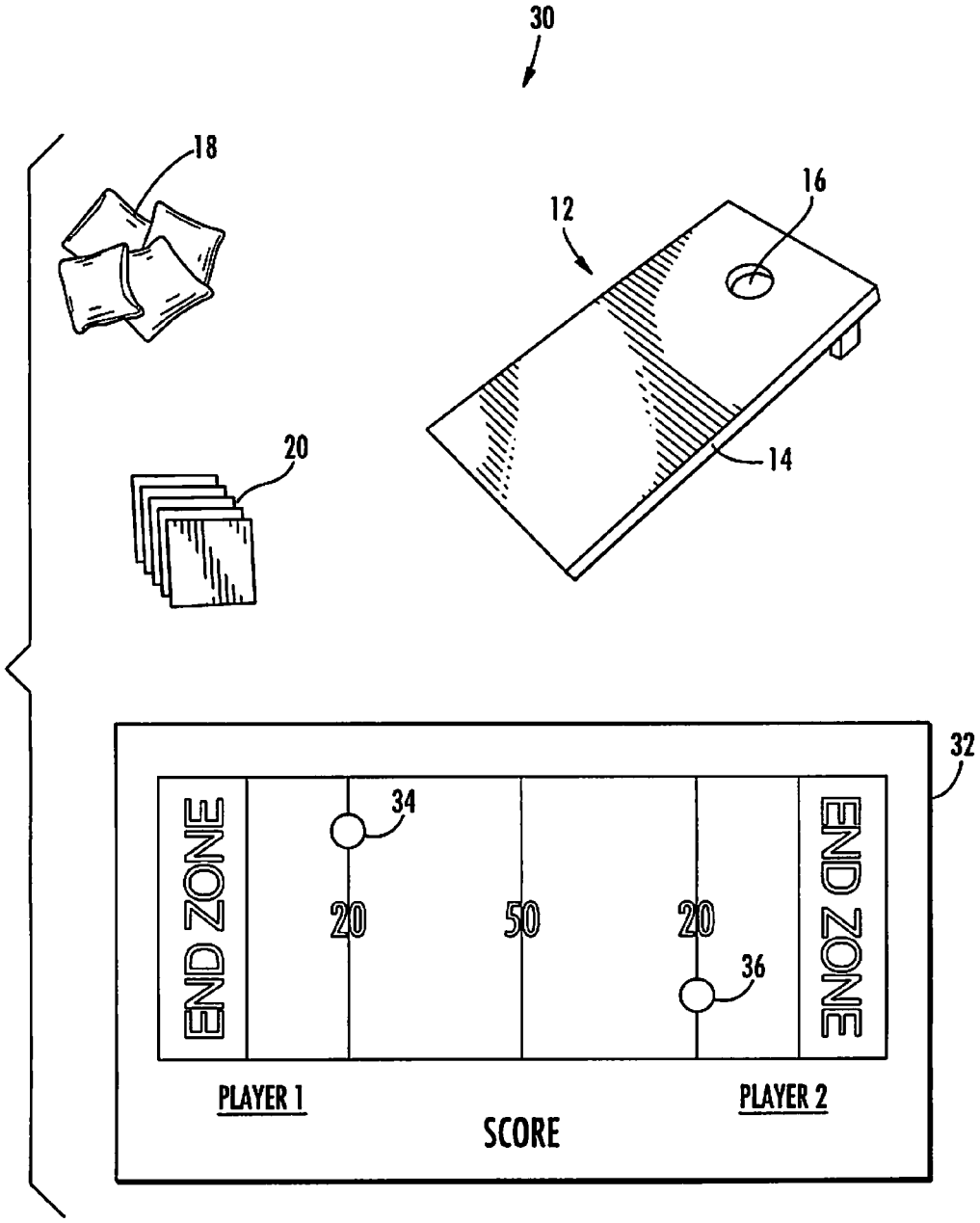
FIG. 2 depicts a football game system according to one embodiment of the present invention.

Referring to FIG. 2, a game system 30 for simulating a football game is shown including the cornhole game board 12, the plurality of objects 18, and the plurality of playing cards 20. The cornhole game board 12 includes an angled platform 14 and a target hole 16 disposed on the platform 14. The plurality of playing cards 20 allow one of at least a first player and a second player to draw one of the plurality of playing cards 20 during a player turn. Additionally, a football scoreboard 32 representing a football field, a first game piece 34 representing the first player, and a second game piece 36 representing the second player are included with the game system 30. The football scoreboard 32 preferably includes a representation of a football field including yard lines and at least one end zone. Additional game pieces may be provided when more than two players or two teams are playing the game. The game pieces 34, 36 are preferably magnetized for conveniently attaching to the scoreboard 32. Other attachment mechanisms are also possible such as Velcro. However, in other embodiments of the invention, the scoreboard 32 may also be electronic with the game pieces 34, 36 represented by lights on the electronic scoreboard 32 or the scoreboard may be a dry erase board.

To begin the football simulated toss game, each player places their game piece 34, 36 at a certain point on the scoreboard 32. For example, as the scoreboard 32 depicts a lifelike football field having typical yard lines, each game piece 34, 36 may be placed initially at the twenty yard line. After flipping a coin to see who goes first, one player at a time will draw a card from the plurality of cards 20. During a player turn, the player will follow the tossing instruction information of the drawn card. Each time the player successfully tosses the object to the cornhole game board 12, the player will move their game piece or their opponent's game piece as stated by the award identified by the tossing instruction information of the drawn card. For example, the first player wins the coin toss and draws a card from the plurality of cards 20. The tossing instruction information of the drawn card identifies an award of a "ten yard run" and an attempt number of "four." The first player then has four attempts to successfully toss the object at the cornhole board. As stated above, in preferred embodiments, a successful toss is one in which the object travels through the target hole 16. If the first player makes two successful throws during his turn, he will move his game piece 34 twenty yards (i.e., two ten yard runs) from the twenty yard line to the forty yard line. In an alternate embodiment, the maximum award allowed during a player turn is one. Thus, although the first player made two successful throws in this example, in the alternate embodiment the first player would only gain a maximum of ten yards. In preferred embodiments, a player is unable to obtain more than one award per turn for the more significant awards identified by the tossing instruction information. The second player then takes his turn by drawing a card from the plurality of cards 20, following the tossing instruction information of the drawn card, and then moving the game piece 36 according to the award obtained during his turn (if any).

A touchdown is scored when a player's game piece is moved along the score board and reaches a goal line. When a touchdown is scored, six points are awarded to the player. The player then tosses the object for an extra point conversion. In preferred embodiments, the scoring player has the option of tossing the object one time for a two-point conversion or the option of tossing the object two times in an attempt to gain one extra point. After attempting the extra point conversion, the game piece 34, 36 of the scoring player goes back to the starting point, e.g., the twenty yard line. The game may end when, for example, each of the plurality of cards has been drawn, a stated point total has been reached, or a specific time period has elapsed.

As shown in FIG. 3, one example of the plurality of cards 20 of the simulated football game, including the type of award, the number of the cards among the plurality of cards identifying the particular award, and the attempt number for each of the particular card, is given. As can be seen when analyzing these characteristics of the plurality of cards 20, the significant award cards such as the "50 yard run" and the "Intercepted Pass Touchdown" generally identify a smaller attempt number. Further, other cards such as the "10 Yard Run" and the "30 Yard Run" are of a notable different value, but the attempt number assigned to these cards is the same. Thus, an element of luck is added to the game system 30 by varying the amount of significant award cards and the attempt numbers. Each of the games simulating other sports preferably includes these features.

Figure 4:
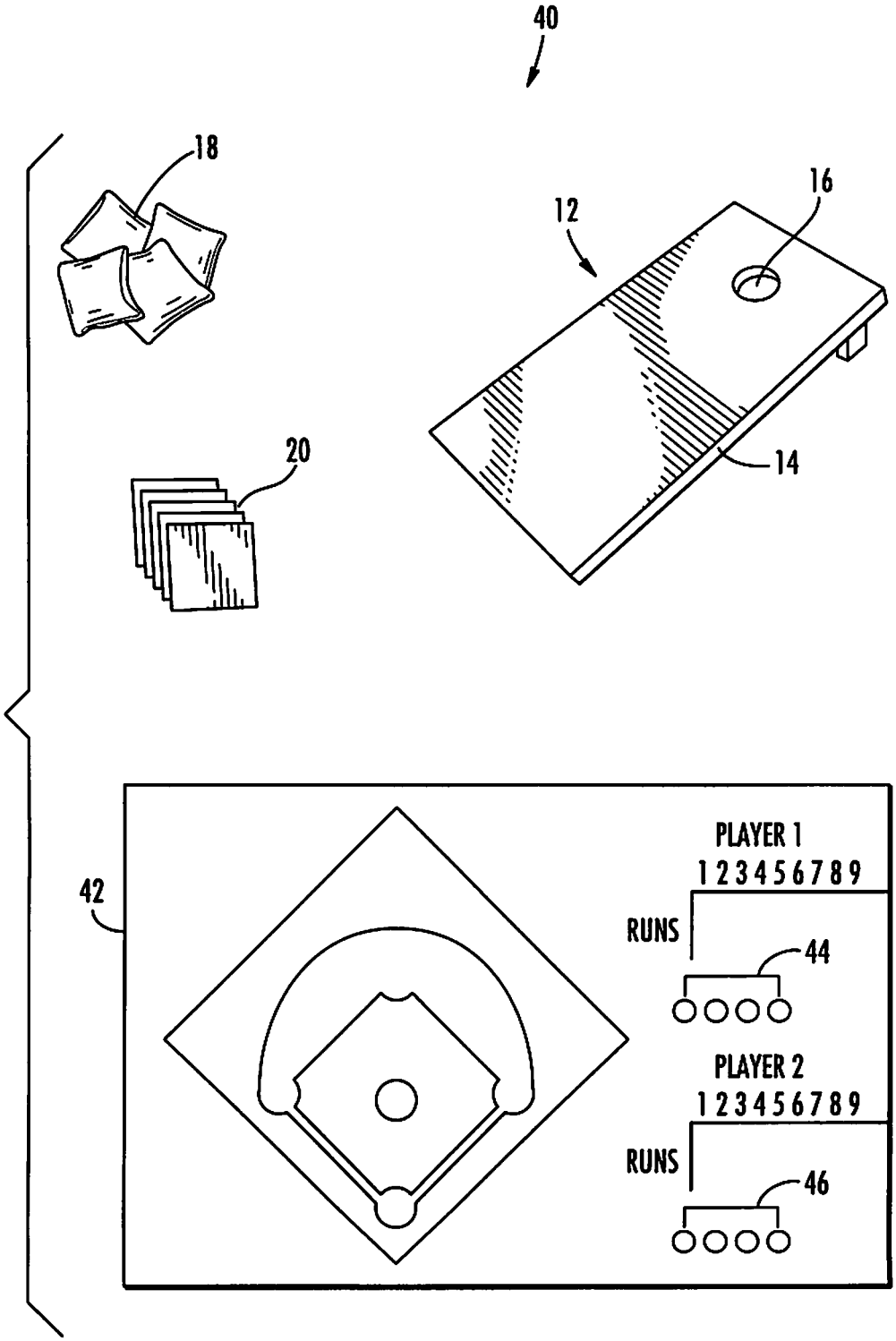
FIG. 4 depicts a baseball game system according to one embodiment of the present invention.

Referring to FIG. 4, a game system 40 for simulating a baseball game is shown including the cornhole game board 12, the plurality of objects 18, and the plurality of cards 20. The scoreboard 42 of the baseball game system 40 represents a baseball field, or, in particular, at least the base path of a baseball field. The first player is given a first set of game pieces 44 representing the first player's base runners and the second player is given a second set of game pieces 46 representing the second player's base runners. The game pieces 44, 46 preferably include magnets so that the game pieces 44, 46 may be easily removeably attached to the scoreboard 42. Other attachment mechanisms are also possible such as Velcro. However, in other embodiments of the invention, the scoreboard 42 may also be electronic and the game pieces 44, 46 may be represented by lights on the electronic scoreboard 42.

To begin the baseball simulated game, each player preferably places one of their game pieces 44, 46 on first, second, and third base of the baseball field. A coin is flipped to see which player goes first, and one player at a time will draw one of the plurality of cards 20 and follow the tossing instruction information identified by the drawn card. Each time a game piece 44, 46 crosses home plate, a run is scored and the player will mark their run on the scoreboard 42. The game may end, for example, after a stated amount of innings, all the cards are drawn, a stated score is reached, or a stated time has elapsed. As shown in FIG. 5, one example of the plurality of cards 20 of the simulated baseball game, including the type of award, the number of the cards among the plurality of cards identifying the particular award, and the attempt number for each of the particular card, is given.

Another embodiment of the invention includes a game system for simulating a fishing contest. Like the other game systems, the fishing game system also includes a cornhole game board 12 and a plurality of cards 20. The fishing game system may also include a scoreboard for marking the total amount of fish and/or the total amount of weight of fish caught during the game. The award identified by each of the plurality of cards 20 preferably includes one of a weight of a fish caught and a "game warden ticket" to be issued to an opponent resulting in the opponent having to subtract weight from their total weight of fish caught. In other words, the "game warden ticket" is an opponent award while the weight of a fish caught is a tosser award.

To begin the fishing simulated game, each player preferably begins with twenty pounds on the scoreboard. A coin is flipped to see which player goes first, and one player at a time will draw one of the plurality of cards 20 and follow the tossing instruction information identified by the drawn card. The game may end, for example, after all the cards are drawn, a stated amount of weight of fish is reached, or a stated time has elapsed. As shown in FIG. 6, one example of the plurality of cards 20 of the simulated fishing game, including the type of award, the number of the cards among the plurality of cards 20 identifying the particular award, and the attempt number for each of the particular card, is given.

Another embodiment of the invention includes a game system for simulating a basketball game. Like the other game systems, the basketball game system includes a cornhole game board 12, a plurality of objects 18, and a plurality of cards 20. The basketball game system may also include a scoreboard for assisting in keeping the players' score during the game. In addition to the award and the attempt number, the tossing instruction information may also include the identification of a distance from the cornhole game board 12 from which the player drawing the card is to toss the object towards the cornhole game board 12 during the player turn. The identification of the distance may be shown by specifically stating the distance or identifying the type of shot (e.g., free throw, dunk, three pointer, etc.) which corresponds to a particular distance. In preferred embodiments, the identification includes a distance selected from one of at least a free throw toss line and a dunk toss line. In preferred embodiments, the free throw toss line is approximately fifteen feet from the cornhole game board 12 and the dunk toss line is approximately ten feet from the cornhole game board. In some embodiments, the card may instruct the player to toss the object with their non-dominant hand such as when the player draws a "dunk" award card. For more advanced players, a three point line may be added for three pointer award cards and is preferably about five feet to ten beyond the main toss line.

To begin the basketball simulated game, a coin is flipped to see which player goes first. One player at a time will draw one of the plurality of cards 20 and follow the tossing instruction information identified by the drawn card. The game may end, for example, after all the cards are drawn, a stated amount of points is reached, or a stated time has elapsed. As shown in FIG. 7, one example of the plurality of cards 20 of the simulated basketball game, including the type of award, the distance from which the player must toss the object to obtain the award, the number of cards among the plurality of cards 20 identifying the particular award, and the attempt number for each of the particular card, is given.

Another embodiment of the invention includes a game system for simulating a presidential election. Like the other game systems, the presidential election game system includes a cornhole game board 12, a plurality of objects, and a plurality of cards 20. Each of the plurality of cards 20 represents a state of the United States. There are 51 cards in total as Washington D.C. is also included as a state for the purpose of this game. The presidential election game system may also include game pieces that identify a particular political party such as Republican, Democrat, Independent, and Tea Party. The award identified by each of the plurality of cards 20 includes a total electoral votes of the state represented by the particular card and the attempt number is based on the total electoral votes of the state. The higher the electoral votes, the fewer attempts a player will generally have for tossing the object to the cornhole game board 20.

To begin the presidential election simulated game, each player picks one of the political parties by choosing one of the game pieces. A coin is flipped to see which player goes first, and one player at a time will draw one of the plurality of cards 20 and follow the tossing instruction information identified by the drawn card. If the player is successful within the number identified by the attempt number, the player receives the electoral votes of the state represented by the drawn card. If the player is unsuccessful, the next player preferably gets to attempt to steal the state of the drawn card. If that player is successful, he or she will receive the electoral votes and draw again. If none of the players are successful, then that state will be discarded into a separate stack identified as "Undecided." The game ends when one party has the necessary two hundred and seventy votes needed to be elected the next President of the United States. If no one has the necessary two hundred and seventy electoral votes, the Undecided cards are shuffled and drawn until two hundred and seventy is reached. If all the electoral votes have been received but no player was able to obtain the necessary two hundred and seventy electoral votes, the "House of Representatives" votes for the next President in a one toss sudden death matchup between the players having the three highest number of electoral votes. As shown in FIG. 8, one example of the plurality of cards 20 of the presidential election game, including the attempt number for each state, is given.

Another embodiment of the invention includes a game system for simulating a round of golf. Like the other game systems, the golf game system also includes a cornhole game board 12 and a plurality of cards 20. The golf game system may also include a scoreboard or scorecard identifying one or more golf "courses" by identifying what par each hole is. The award identified by each of the plurality of cards 20 preferably includes various actions that affect one score in golf. A first set of cards identifies a positive award in which the player's score is improved and/or the player receives a mulligan for redoing a toss. A second set of cards identifies a negative award in which the player's score is negatively impacted.

As in the real game of golf, a player must get to the "green" prior to "putting" in the golf simulated game. The rules for getting to the green vary based on what par the particular hole is identified as on the scorecard. For a "Par Three," a player gets to the green by tossing the object so that it rests on the platform 14 of the cornhole game board 12. Once a player makes it to the green, the player begins "putting" by tossing the object until the player successfully tosses the object to the cornhole game board, i.e., through the target hole 16 of the cornhole game board 12. Should the player successfully toss the object to the cornhole game board 12 on the first attempt on a par three, the player is awarded a hole-in-one. For a "Par Four," a player gets to the green by tossing the object so that it is either successfully tossed through the target hole 16 of the cornhole game board 12 on the first attempt or the player has made two attempts in which the object has twice come to rest on the platform 14. At that point, the player begins putting as explained with respect to the par three. For a "Par Five," a player gets to the green by tossing the object so that it is either successfully tossed through the target hole 16 of the cornhole game board 12 twice, the player has made three attempts in which the object has come to rest on the platform 14, or the player has made one successful toss and two (or one if the players so choose) tosses in which the object has come to rest on the platform 14. At that point, the player begins putting as explained with respect to the par three.

Prior to a player's turn, the player will refer to the score card to determine what par the hole is identified as and will draw one of the plurality of cards that will impact the score in which the player will be able to receive on that hole as described above. As shown in FIG. 9, one example of the plurality of cards 20 of the golf simulated game system, including the award, is given. The game ends when a stated amount of holes have been completed. The maximum tosses per hole may also be maxed out at eight.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method for playing a tossing and card game that simulates a sport comprising:

(a) providing a game board having an angled platform including a target hole disposed on the platform;

(b) providing a plurality of playing cards each having tossing instruction information including identification of an award representing an activity involved in the sport and an attempt number representing a number of tosses in which one of a first player and a second player has to toss an object through the target hole of the game board in order to obtain the award;

(c) drawing one of the plurality of playing cards during a first player turn taken by the first player;

(d) tossing the object during the first player turn according to the attempt number identified in the drawn playing card and awarding the first player the award identified in the drawn playing card by performing the activity represented by the award on a scoreboard if the first player successfully tosses the object through the target hole;

(e) drawing one of the plurality of playing cards during a second player turn taken by the second player;

(f) tossing the object during the second player turn according to the attempt number identified in the drawn playing card and awarding the second player the award identified in the drawn playing card by performing the activity represented by the award on the scoreboard if the second player successfully tosses the object through the target hole; and (g) repeating steps (c)-(f) until one of each of the plurality of playing cards has been drawn, one of the first player and the second player reaches a stated point total, and a stated time period has elapsed.

* * * * *